US006161691A

United States Patent [19]

Ratcliff et al.

[11] Patent Number: 6,161,691

[45] Date of Patent: Dec. 19, 2000

[54] GOLF BAG PUTTER MOUNT

[76] Inventors: William R. Ratcliff, 2626 E. 72nd St., Tulsa, Okla. 74136; Terrell W. Harrison, 8831 Haskell Dr., Broken Arrow, Okla. 74014

[21] Appl. No.: 09/412,156

[22] Filed: Oct. 5, 1999

[51] Int. Cl.[7] ..... A63B 57/00

[52] U.S. Cl. ..... 206/315.2; 206/315.6; 211/70.2; 248/274

[58] Field of Search ..... 206/315.2, 315.3, 206/315.6; 211/70.2; 224/274

[56] References Cited

U.S. PATENT DOCUMENTS

| | | | |
|---|---|---|---|
| 3,503,518 | 3/1970 | Black | 206/315.6 X |
| 3,613,760 | 10/1971 | Koehnle | 150/160 |
| 3,667,078 | 6/1972 | Distasio | 15/104.92 |
| 4,378,832 | 4/1983 | Thompson | 150/160 |
| 4,863,019 | 9/1989 | Lewis et al. | 206/315.3 |
| 4,932,523 | 6/1990 | Yamazoe | 206/315.6 |
| 5,000,238 | 3/1991 | Zeller | 150/160 |
| 5,050,655 | 9/1991 | Borenstein | 150/160 |
| 5,050,884 | 9/1991 | Flory | 273/162 R |
| 5,117,884 | 6/1992 | Diener et al. | 150/160 |
| 5,215,136 | 6/1993 | Flanders et al. | 150/160 |
| 5,299,611 | 4/1994 | Cirone | 150/160 |
| 5,437,320 | 8/1995 | Sung | 150/160 |
| 5,458,240 | 10/1995 | Rich et al. | 206/315.3 |
| 5,511,660 | 4/1996 | Yamada et al. | 206/315.6 |
| 5,617,951 | 4/1997 | Wick | 206/315.2 X |
| 5,755,322 | 5/1998 | Yang | 206/315.2 |
| 5,779,043 | 7/1998 | Hsu et al. | 206/315.2 X |
| 5,803,252 | 9/1998 | Huo-Chuan | 206/315.2 X |
| 5,862,909 | 1/1999 | Jacobsen | 206/315.3 |

*Primary Examiner*—Sue A. Weaver
*Attorney, Agent, or Firm*—Frank J. Catalano

[57] ABSTRACT

A mount for securing a putter in a golf bag has a bracket seatable on and securable to the mouth of the golf bag and an elongated open-top receptacle pivotally mounted proximate its longitudinal center to and above the bracket. The receptacle has a bottom wall opening through which the putter shaft extends into the golf bag and side walls contoured to receive the head of the putter with at least a portion of the top of the putter head resting on the bottom wall of the receptacle. The pivotal angular relationship between the receptacle and the bracket is adjustable to a position in which the putter shaft is aligned approximately parallel to the longitudinal axis of the golf bag when the putter head is resting on the bottom of the receptacle. The receptacle can be interchanged to accommodate either blade or mallet style putters. The same receptacle accommodates both left and right handed putters.

20 Claims, 4 Drawing Sheets

GOLF BAG PUTTER MOUNT

BACKGROUND OF THE INVENTION

This invention relates generally to golf equipment and more particularly concerns a mount for securing a putter in a golf bag.

It is common practice to carry a putter in a golf bag together with the other golf clubs. Generally, this involves releasing of the putter in an inverted vertical orientation within the bag and allowing the putter to find its resting place in the bag. The practice has many disadvantages. For many players, the putter is the shortest of the clubs used and, frequently, is shorter than the golf bag itself. Thus, it is not uncommon for the head of the putter to strike the mouth of the golf bag before the grip reaches the bottom of the bag. This results in wear on the mouth of the bag. Furthermore, the putter often assumes an awkward position in the bag which interferes with the insertion and removal of the other clubs. Another problem is that the contour of the putter head is markedly different than the contour of the heads of the other clubs in the bag so that, even if the grip end of the putter rests on the bottom of the bag, the putter head does not symmetrically align with the heads of the other clubs in the bag. The resulting contact between the clubs causes damage to both the putter and the other clubs. For this reason, it is not uncommon for golfers to use a removable cover to prevent the putter head from contacting the other clubs. However, since the putter is the most often used club in the bag, the constant removal and replacement of the cover from the putter head during the course of a round of golf quickly becomes frustrating and bothersome. In many instances, the golfer will opt to use the putter cover only during transportation of the clubs and not during play.

It is, therefore, an object of this invention to provide a protective cover for a putter head. Another object of this invention is to provide a putter cover adaptable to a golf bag for securing the putter in a desirable position in the bag. Still another object of this invention is to provide a putter mount which secures the putter in a substantially inverted condition with the putter shaft approximately aligned with the longitudinal axis of the golf bag. A further object of this invention is to provide a putter mount which is adaptable to secure any one of a variety of putters to the golf bag with the putter shaft approximately aligned with the longitudinal shaft of the bag.

SUMMARY OF THE INVENTION

In accordance with the invention, a mount is provided for securing a putter in a golf bag. A bracket, preferably shaped like a fork, is seatable on the mouth of the golf bag with the upper portion of the golf bag wall extending between its prongs. A set screw threaded through one of the prongs is rotatable into abutment with the golf bag wall to clamp the golf bag wall between the set screw and the other prong, thus securing the bracket to the bag. An elongated open-top receptacle is pivotally mounted proximate its longitudinal center to and above the bracket. The receptacle bottom wall has an opening through which the putter shaft extends into the golf bag. The receptacle side walls have a horizontal cross-section contoured to receive the head of the putter with at least a portion of the top of the putter head resting on the bottom wall of the receptacle when the shaft is substantially fully extended below the opening. The pivotal angular relationship between the receptacle and the bracket is adjustable to a position in which the putter shaft is aligned approximately parallel to the longitudinal axis of the golf bag when the putter head is resting on the bottom of the receptacle.

Preferably, the upper portion of the bracket is a post with a horizontal aperture transverse to the elongated receptacle and the lower portion of the receptacle is a clevis. A bolt or pin extending through the aperture and clevis serves as a pintle pivotally connecting them. A lock washer disposed between the post and the clevis cooperates with the pintle to secure the bracket and receptacle in their proper angular relationship.

When used with blade style putters, the receptacle has a substantially rectangular horizontal cross-section, the opening for the putter shaft is at one end of the receptacle bottom and, preferably, an opening in the receptacle side wall aligned with the bottom wall opening allows the putter shaft to be laterally inserted into the receptacle after it is vertically inserted into the bag.

When used with mallet style putters, the receptacle has a substantially semi-circular horizontal cross-section, the opening for the putter shaft is at one end of the receptacle bottom and, preferably, an opening in the receptacle side wall aligned with the bottom wall opening allows the putter shaft to be laterally inserted into the receptacle after it is vertically inserted into the bag. To accommodate both left and right handed mallet style putters, the receptacle preferably also has a second putter shaft opening at the other end of the receptacle bottom and a second opening in the side wall aligned with the second bottom wall opening, allowing the putter shaft to be laterally inserted into the receptacle at either end.

BRIEF DESCRIPTION OF THE DRAWINGS

Other objects and advantages of the invention will become apparent upon reading the following detailed description and upon reference to the drawings in which.

DETAILED DESCRIPTION

Figure 1:
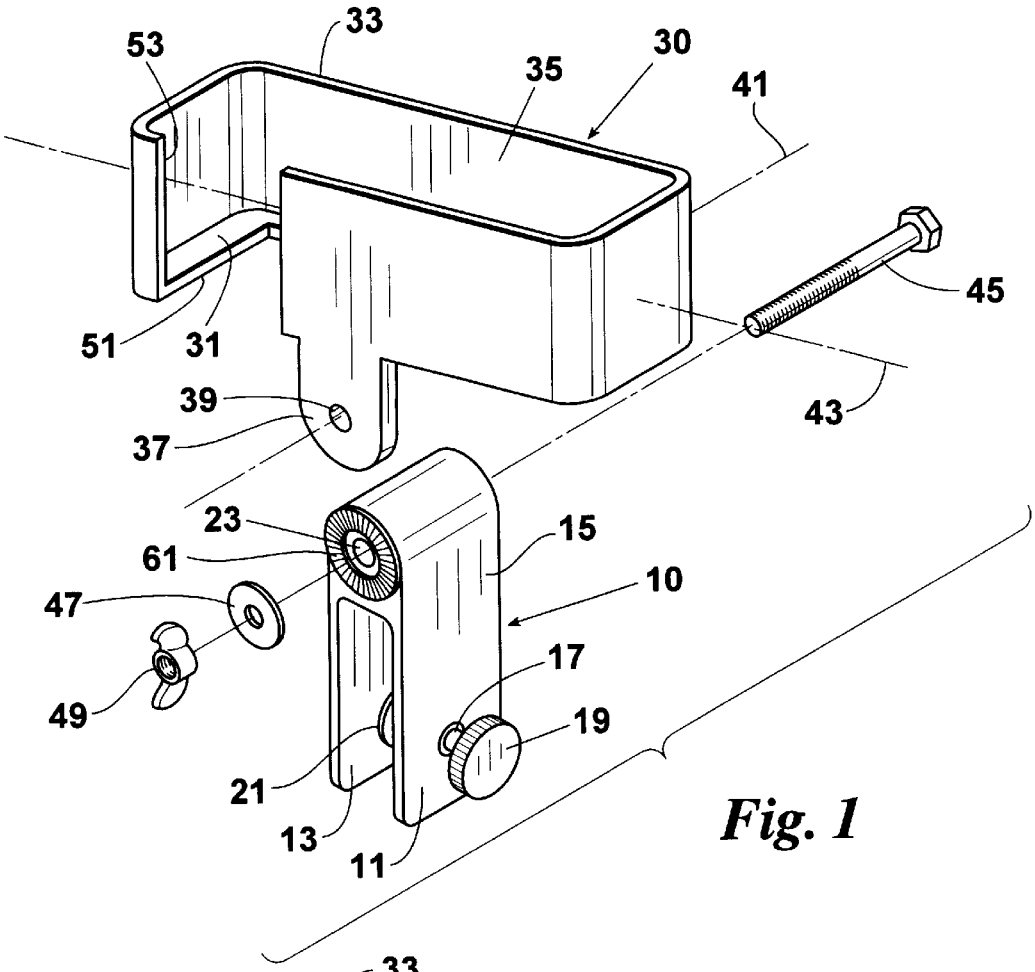
FIG. 1 is a perspective assembly view of a preferred embodiment of the golf bag putter mount for use with blade style putters.
Figure 2:
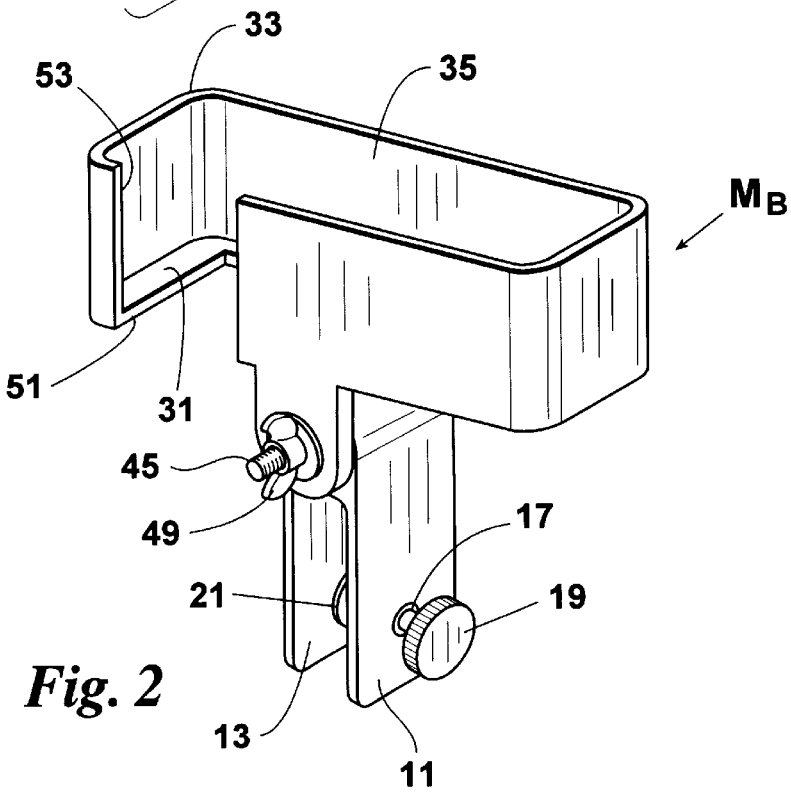
FIG. 2 is a perspective view of the mount of FIG. 1 in the assembled condition.
Figure 3:
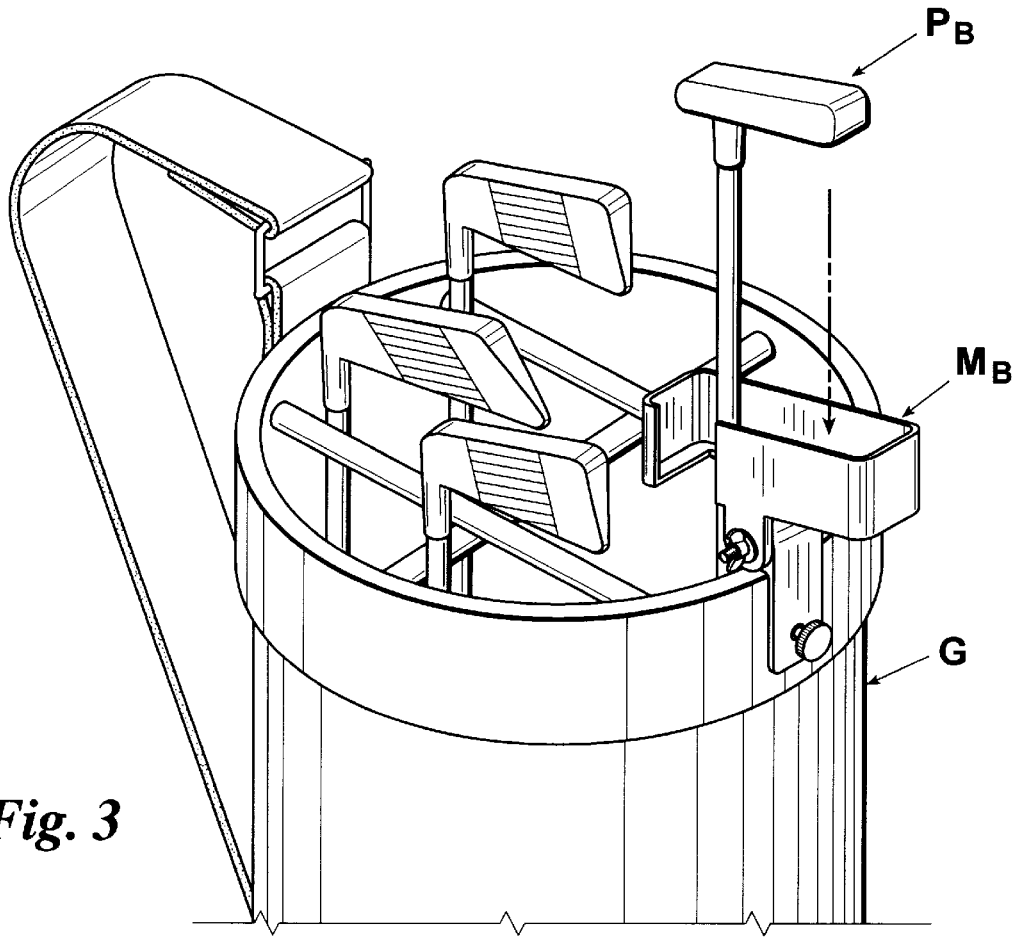
FIG. 3 is a perspective view of the mount of FIG. 1 attached to the golf bag.

Turning first to FIGS. 1 through 4, a putter mount $M_B$ is shown for securing a blade style putter $P_B$ in a golf bag G. The mount $M_B$ has a bracket 10 in the shape of a fork having prongs 11 and 13 extending downwardly from a post 15. A set screw 17 extends through one of the prongs 11. Preferably, the set screw 17 has a knob 19 on its outer end to facilitate tightening and loosening the set screw 17 and a screw plate 21 on its end disposed between the prongs 11 and 13. As can best be seen in FIG. 3, with the bracket 10 seated on the mouth of the golf bag G, the set screw 17 is tightened to clamp the upper portion of the golf bag G between the screw plate 21 and the other prong of the bracket 10, thus securing the bracket 10 in place in the golf bag G. The bracket post 15 has an aperture 23 extending horizontally and transverse to the set screw 17. An elongated, open top receptacle 30 has a bottom wall 31 and upwardly extending side walls 33. As can best be seen in FIG. 3, the side walls form a pouch 35 having a horizontal cross section contoured to receive the head of the putter $P_B$. The lower portion of the receptacle 30 is provided with a clevis 37 with apertures 39. The clevis is positioned proximate the longitudinal center 41 of the receptacle 30 and extends downwardly to straddle the post 15 of the bracket 11. When the post and clevis apertures 23 and 39 are aligned, the longitudinal axis 43 of the receptacle 30 is transverse to the longitudinal axis extending through the apertures 23 and 39 and parallel to the rotational axis of the set screw 17 in the bracket 10. A pintle, such as a pin or bolt 45 extends through the apertures 23 and 39 to permit the receptacle 30 to pivot in relation to the bracket 10. As shown, the bolt 45 is held in place by use of a flat washer 47 and wing nut 49. An opening 51 in the bottom wall 31 of the receptacle 30 allows the shaft of the putter $P_B$ to extend through the receptacle 30 into the golf bag G. Preferably, a side wall opening 53 aligned with the bottom wall opening 51 allows the shaft of the putter $P_B$ to be inserted laterally into the receptacle 30.

Figure 4:
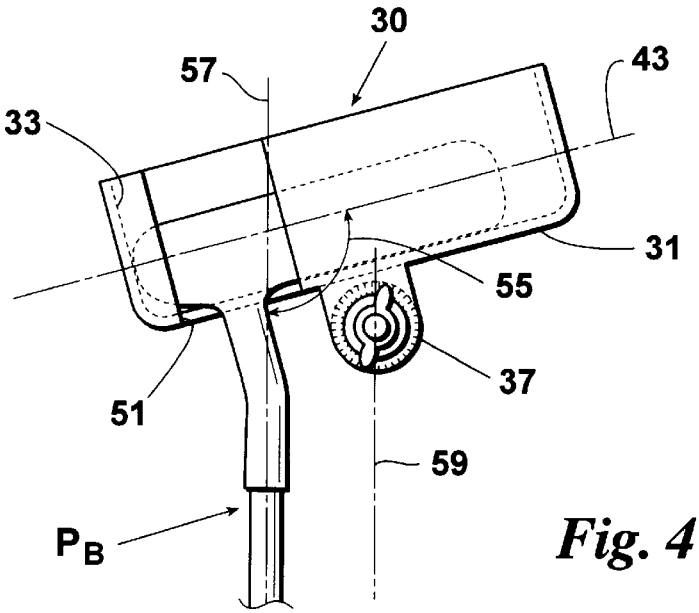
FIG. 4 is a side elevation view illustrating a blade style putter fully seated in the mount of FIG. 1.
Figure 5:
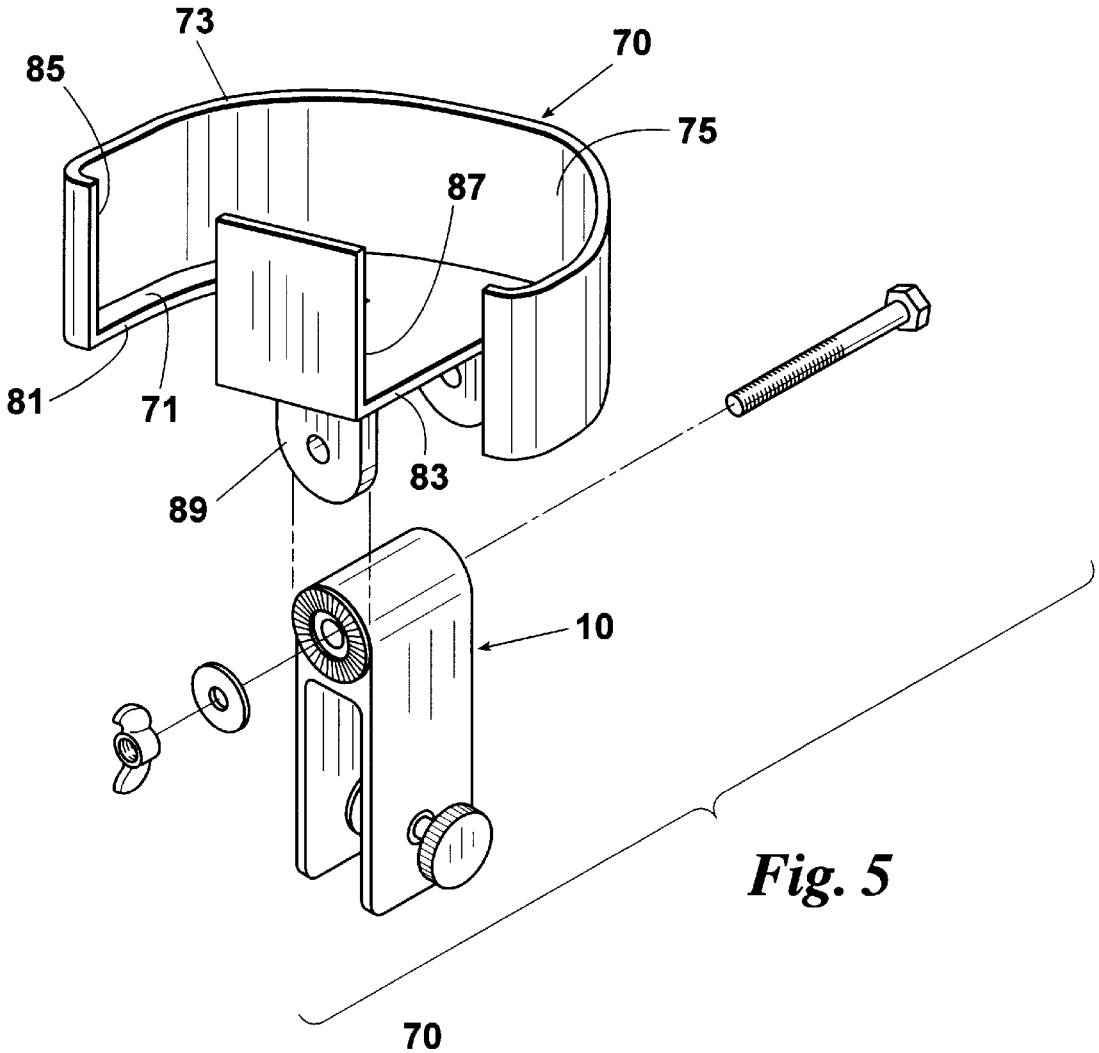
FIG. 5 is a perspective assembly view of a preferred embodiment of the golf bag putter mount for use with mallet style putters.
Figure 6:
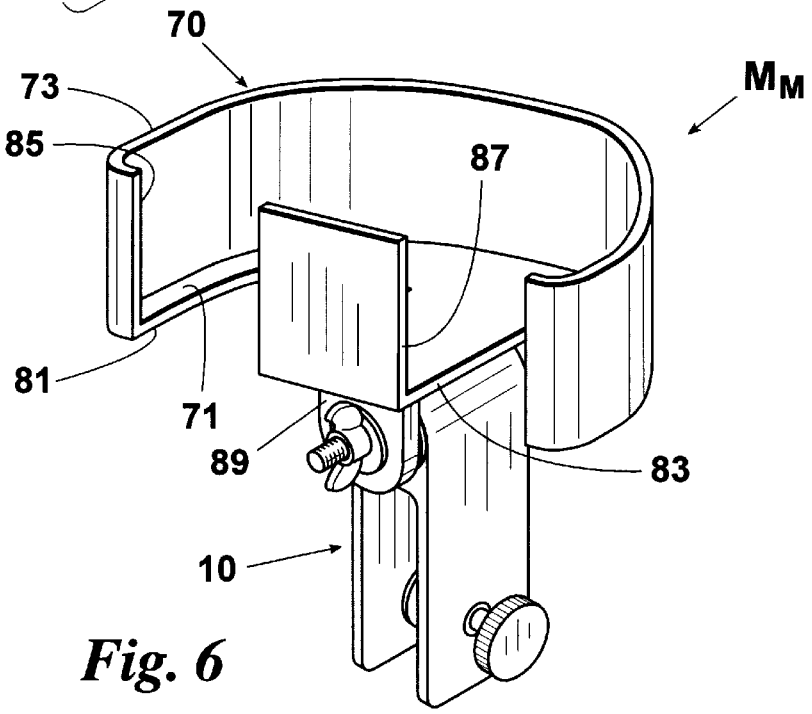
FIG. 6 is a perspective view of the mount of FIG. 5 in the assembled condition.
Figure 7:
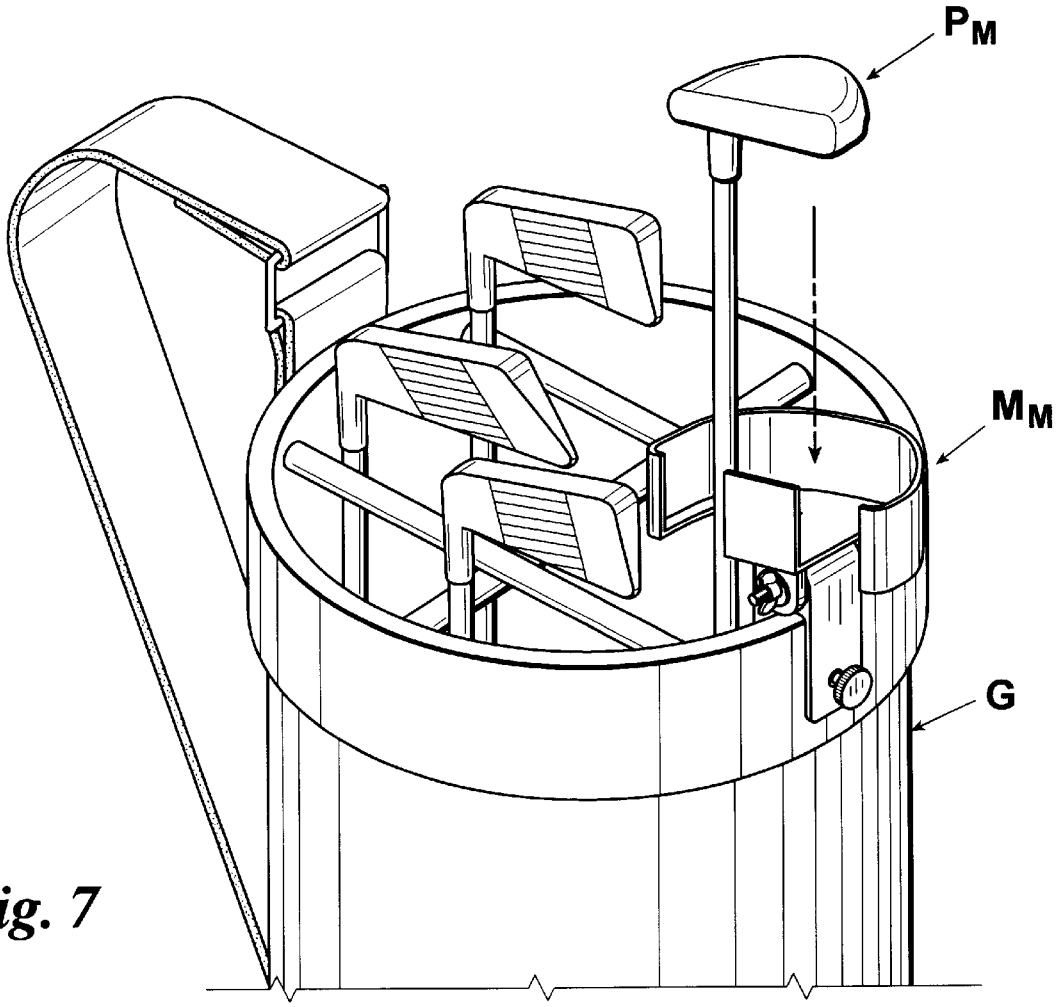
FIG. 7 is a perspective view of the mount of FIG. 5 attached to the golf bag.
Figure 8:
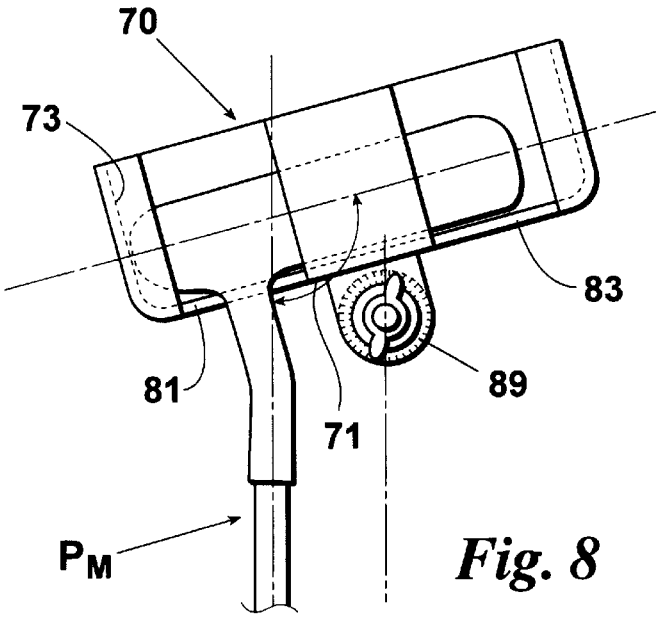
FIG. 8 is a side elevation view illustrating a mallet style putter fully seated in the mount of FIG. 5.

As can best be seen in FIG. 4, the angular relationship 55 between the axis 57 of the shaft of the putter $P_B$ and the longitudinal axis 43 of the receptacle 30 is pivotally adjusted by loosening the pintle bolt 45 and rotating the receptacle 30 until, when the top face of the putter $P_B$ abuts the bottom wall 31 of the receptacle, the shaft axis 57 is substantially parallel to the longitudinal axis 59 of the wall of the bag G. Once the proper alignment angle 55 is achieved, the pintle bolt 45 is retightened to secure this relationship. Preferably, a lock washer 61, best seen in FIGS. 1 and 4, enhances the tightness of the pivot between the bracket 10 and the receptacle 30.

Turning to FIGS. 5–8, a putter mount $P_M$ useful for securing a mallet style putter $P_M$ in the golf bag G is illustrated. The mallet putter mount $P_M$ is identical in all respects to the blade putter mount $P_B$ shown in FIGS. 1–4, except that the receptacle 70 has side walls 73 forming a pouch 75 of substantially semi-circular cross-section to accommodate the mallet shape of the head of the putter $P_M$. In addition, the mallet putter mount $P_M$ has two bottom wall openings 81 and 83, one at either end of the receptacle 70, and two side wall openings 85 and 87, one aligned with each of the bottom wall openings 81 and 83. This permits a single mallet putter mount $P_M$ to accommodate either left or right handed putters, it simply being necessary to either invert the position of the receptacle 70 on the bracket 10 or invert the position of the bracket 10 on the golf bag G. Furthermore, since the mallet style putter $P_M$ is typically wider than the blade style putter $P_B$, the clevis 89 is positioned slightly differently on the receptacle 70 than the clevis 37 on the receptacle 30 of the blade putter mount $M_B$ so as to maintain the same distance across the devises 37 and 89. Therefore, the same bracket 10 will accommodate either receptacle 30 or 70.

The bracket 10 and receptacles 30 and 70 can be made of steel, aluminum, plastic or other suitable material. Preferably, the interior of the pouch 35 or 75 is lined with felt or fur to protect the surface of the head of the putter $P_B$ or $P_M$. If the golfer changes from one blade stye putter to another or from one mallet style putter to another, it is necessary at most to change the angular relationship of the bracket 10 and the receptacle 30 or 70 as hereinbefore described. The mount will store the putter $P_B$ or $P_M$ in good alignment in the golf bag G and protect the head of the putter $P_B$ or $P_M$ and the mouth of the bag G from damage.

Thus, it is apparent that there has been provided, in accordance with the invention, a golf bag putter mount that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A mount for securing a putter having a head and a shaft in a golf bag having a container extending along a longitudinal axis to a mouth comprising:

a bracket seatable on the golf bag mouth;

means for securing said bracket to the golf bag mouth on which it is seated;

an elongated open-top receptacle pivotally mounted proximate a longitudinal center thereof to and above said bracket, said receptacle having a bottom wall with an opening for extension of the putter shaft therethrough into the golf bag and side walls forming a pouch of horizontal cross-section contoured for reception of the head of the putter therein with at least a portion of a top of the putter head resting on said bottom wall when the shaft is substantially fully extended below said opening, an angular relationship between said receptacle and said bracket being adjustable to a position such that, when the at least a portion of the putter head is resting on said bottom of said receptacle, the putter shaft is aligned approximately parallel to the longitudinal axis of the golf bag; and means cooperable with said bracket and said receptacle to secure said bracket and said receptacle in said position.

2. A mount according to claim 1, said bracket comprising a fork having prongs for receiving an upper portion of the golf bag wall therebetween.

3. A mount according to claim 2, said securing means comprising a set screw threadedly extending through one of said prongs for rotation into abutment with the golf bag wall to clamp the golf bag wall between said set screw and another of said prongs.

4. A mount according to claim 2, an upper portion of said fork being a post having an aperture therethrough and a lower portion of said receptacle being a clevis, said mount further comprising a pintle pivotally connecting said post and said clevis.

5. A mount according to claim 4 further comprising means disposed between said post and said clevis for preventing relative rotation thereof.

6. A mount according to claim 5, said preventing means comprising a lock washer.

7. A mount according to claim 1, said receptacle having a substantially rectangular horizontal cross-section.

8. A mount according to claim 7, said opening being at one end of said receptacle bottom.

9. A mount according to claim 8, said receptacle having an opening in said side wall thereof and aligned with said bottom wall opening whereby the putter shaft is laterally insertable into said receptacle.

10. A mount according to claim 1, said receptacle having a substantially semi-circular horizontal cross-section.

11. A mount according to claim 10, said opening being at one end of said receptacle bottom.

12. A mount according to claim 11, said receptacle having an opening in said side wall thereof and aligned with said bottom wall opening whereby the putter shaft is laterally insertable into said receptacle.

13. A mount according to claim 10, said receptacle having a second opening in said bottom thereof, one opening at each end of said receptacle bottom.

14. A mount according to claim 13, said receptacle having a pair of openings in said side wall thereof, one aligned with each said bottom wall opening whereby the putter shaft is laterally insertable into said receptacle at either end of said bottom.

15. A mount for securing a putter having a head and a shaft in a golf bag having a container extending along a longitudinal axis to a mouth comprising:

a bracket seatable on the golf bag mouth;

means for securing said bracket to the golf bag mouth on which it is seated;

an elongated open-top receptacle mounted proximate a longitudinal center thereof to and above said bracket, said receptacle having a bottom wall with an opening for extension of the putter shaft therethrough into the golf bag and side walls forming a pouch of horizontal cross-section contoured for reception of the head of the putter therein with at least a portion of a top of the putter head resting on said bottom wall when the shaft is substantially fully extended below said opening, an angular relationship between said receptacle and-said bracket being such that, when the at least a portion of the putter head is resting on said bottom of said receptacle, the putter shaft is aligned approximately parallel to the longitudinal axis of the golf bag.

16. A mount according to claim 15, said bracket comprising a fork having prongs for receiving an upper portion of the golf bag wall therebetween.

17. A mount according to claim 16, said securing means comprising a set screw threadedly extending through one of said prongs for rotation into abutment with the golf bag wall to clamp the golf bag wall between said set screw and another of said prongs.

18. A mount according to claim 15, said receptacle having an opening in said side wall thereof and aligned with said bottom wall opening whereby the putter shaft is laterally insertable into said receptacle.

19. A mount according to claim 15, said receptacle having a substantially rectangular horizontal cross-section.

20. A mount according to claim 15, said receptacle having a substantially semi-circular horizontal cross-section.

* * * * *